US007789128B2

(12) United States Patent
Rehberg

(10) Patent No.: US 7,789,128 B2
(45) Date of Patent: Sep. 7, 2010

(54) PLATE-TYPE HEAT EXCHANGER FOR DRYING A GASEOUS MEDIUM

(75) Inventor: Peter Rehberg, Berlin (DE)

(73) Assignee: Gea WTT GmbH, Nobitz-Wilchwitz (DE)

( * ) Notice: Subject to any disclaimer, the term of this patent is extended or adjusted under 35 U.S.C. 154(b) by 1436 days.

(21) Appl. No.: 10/962,379

(22) Filed: Oct. 8, 2004

(65) Prior Publication Data

US 2008/0210411 A1 Sep. 4, 2008

(30) Foreign Application Priority Data

Oct. 10, 2003 (DE) ..... 103 47 880

(51) Int. Cl.

| | |
|---|---|
| ***F28F 3/00*** | (2006.01) |
| ***F28B 9/10*** | (2006.01) |
| ***F28B 3/00*** | (2006.01) |
| ***F28F 13/06*** | (2006.01) |
| ***A23C 3/02*** | (2006.01) |
| ***F25D 17/06*** | (2006.01) |

(52) U.S. Cl. ..... 165/166; 165/66; 165/108; 165/112; 165/113; 62/90; 62/93; 62/95

(58) Field of Classification Search ..... 165/166, 165/112, 108, 66, 113; 62/93, 90, 95
See application file for complete search history.

(56) References Cited

U.S. PATENT DOCUMENTS

| | | | | |
|---|---|---|---|---|
| 1,781,515 | A * | 11/1930 | Lewis | 261/129 |
| 2,808,237 | A * | 10/1957 | Fosnes | 165/122 |
| 3,797,565 | A | 3/1974 | Fernandes | 165/111 |
| 5,275,233 | A | 1/1994 | Little | |
| 5,333,683 | A | 8/1994 | Arriulou et al. | 165/166 |
| 5,434,002 | A | 7/1995 | Yoon et al. | 428/357 |
| 6,085,529 | A * | 7/2000 | Galus et al. | 62/93 |
| 2003/0041619 | A1 | 3/2003 | Lu | 62/617 |

FOREIGN PATENT DOCUMENTS

| | | |
|---|---|---|
| DE | 41 18 298 A1 | 1/1992 |
| DE | 43 42 598 A1 | 6/1995 |
| DE | 197 37 205 A1 | 3/1999 |
| DE | 203 15 267 U1 | 4/2004 |
| DE | 103 11 602 A1 | 9/2004 |
| EP | 0 546 947 A1 | 6/1993 |

* cited by examiner

*Primary Examiner*—Cheryl J Tyler
*Assistant Examiner*—Bandon M Rosati
(74) *Attorney, Agent, or Firm*—Merchant & Gould P.C.

(57) ABSTRACT

The invention relates to a plate-type heat exchanger for drying a gaseous medium, especially air, comprising a stack of plates which are interconnected to define flow spaces between the plates, a gas-gas heat exchanger being formed in one portion of the stack, with a moist inlet gas stream flowing away from an inlet gas connection and a dried outlet gas stream flowing towards an outlet gas connection, both flowing next to each other through separate flow spaces to exchange thermal energy, and a gas-coolant heat exchanger being formed in another portion of the stack, with a coolant and the moist inlet gas stream flowing next to each other through further separate flow spaces for cooling purposes, and a flow connection being formed between an outlet of the gas-coolant heat exchanger and the gas-gas heat exchanger, in-cluding an overflow member to guide the dried outlet gas stream through the overflow member from the gas-coolant heat exchanger to the gas-gas heat exchanger The overflow member is formed of a stack of adjacent plates which are interconnected to define overflow spaces between the adjacent plates, contact zones being established between side surfaces facing each other of the adjacent plates.

6 Claims, 1 Drawing Sheet

PLATE-TYPE HEAT EXCHANGER FOR DRYING A GASEOUS MEDIUM

The invention relates to the art of plate-type heat exchangers for drying a gaseous medium, especially air.

BACKGROUND OF THE INVENTION

Gaseous media, for example, air are used as process agents in production processes which vary greatly. Typically, the gaseous medium must have certain properties for the respective production process, such as having a given degree of purity or a minimum moisture content. Known plate-type heat exchangers are employed to dry a gaseous medium, for instance, pressurized air so that the resulting gaseous medium to be used as a process agent will have only a predetermined degree of moisture. To accomplish that, the gaseous medium is supplied through an inlet connection into a plate-type heat exchanger. Having been thus fed, the moist inlet gas stream flows through a gas-gas heat exchanger. The gas-gas heat exchanger is formed in the plate-type heat exchanger in a portion of the stack of plates which are interconnected to define flow spaces between the plates. In the known plate-type heat exchanger the moist inlet gas stream flows away from the inlet connection and a dried outlet gas stream flows towards an outlet connection, possibly to be returned into the production process, the two streams flowing through separate flow spaces in the stack of plates. The moist inlet gas stream and the dried outlet gas stream flow in countercurrent, whereby the moist inlet gas stream, on the one hand, is precooled. On the other hand, the dried outlet gas stream is heated by thermal transfer from the moist inlet gas stream to the previously dried outlet gas stream.

The moist inlet gas stream passes from the gas-gas heat exchanger into a gas-coolant heat exchanger in the stack of plates. The gas-coolant heat exchanger likewise comprises a plurality of flow spaces between the plates of the stack. In the gas-coolant heat exchanger, the precooled inlet gas stream and a cooling agent flow in countercurrent, whereby the moist inlet gas stream is cooled down, leading to subsequent condensation of the moisture particles in the inlet gas stream so that the inlet gas stream becomes dry. The resulting dried outlet gas stream flows through an overflow member from the outlet of the gas-coolant heat exchanger to the gas-gas heat exchanger where it is heated again by absorption of heat from the incoming inlet gas stream. The outlet gas stream thus heated flows through the outlet connection of the plate-type heat exchanger towards further use.

Due to pressure conditions prevailing in the gas-gas heat exchanger and in the gas-coolant heat exchanger the overflow member, too, must fulfill strict requirements regarding resistance to pressure.

It is, therefore, an object of the invention to provide a plate-type heat exchanger for drying a gaseous medium which will allow and withstand high pressurization under operating conditions, thereby guaranteeing that safety standards are complied with.

The object is met, in accordance with the invention, by a plate-type heat exchanger as recited in independent claim 1.

SUMMARY OF THE INVENTION

The invention embraces the concept of providing a plate-type heat exchanger for drying a gaseous medium, especially air, comprising a gas-gas heat exchanger and a gas-coolant heat exchanger in a stack of plates, with an overflow member in a flow connection between the outlet of the gas-coolant heat exchanger and the gas-gas heat exchanger. The overflow member is made up of a stack of adjacent plates which are interconnected to define overflow spaces between adjacent plates. Side surfaces facing each other of the adjacent plates present contact zones between them where the side surfaces facing each other of the adjacent plates are connected to each other. In this manner direct contact is obtained between the side surfaces facing each other of the adjacent plates of the overflow member. Optionally, the contact may be established by a suitable connecting means. This type of connection between side surfaces facing each other of the adjacent plates in the overflow member permits contact connections to be provided which allow high pressurization in the overflow spaces through which the dried outlet gas stream flows from the gas-coolant heat exchanger to the gas-gas heat exchanger. Other than with known plate-type heat exchangers including an overflow member composed of top and bottom plates which are interconnected by a surrounding wall, the fact that contact zones of side surfaces which face each other are joined guarantees reliable operation even under very high pressure loading. Consequently, a higher degree of operational safety is achieved.

According to a convenient modification of the invention adjacent plates are connected by soldering at the deflector member whereby a reliable and firm connection is warranted between the adjacent plates. Moreover, the connection between adjacent plates of the overflow member can be obtained by applying the same manufacturing technique as normally used for interconnecting the plates of the stack in which the gas-gas heat exchanger and the gas-coolant heat exchanger are formed.

In a preferred further development of the invention it is provided that the contact zones at the overflow member include edge contact zones where edge portions of the side surfaces facing each other of adjacent plates are in touch with each other, optionally by way of a connecting material. This assures a pressure tight connection which is continuous along the edge of the overflow member between the adjacent plates of the stack of plates at the overflow member.

It may be provided conveniently, with an embodiment of the invention, that the contact zones at the overflow member include areal contact zones where, in a central part each of the adjacent plates, sections projecting from a plane of a plate, presenting the side surfaces which face each other of adjacent plates, are in touch with each other. This measure helps to optimize the pressure resistance of the overflow member because direct connections are formed at selectable spacings, distributed throughout the adjacent plates, between side surfaces facing each other. This supports the application of higher pressures in the operation of the plate-type heat exchanger.

The strength of adjacent plates of the overflow member is improved in an advantageous embodiment of the invention in that the adjacent plates of the overflow member are given an embossed surface structure, at least in partial areas. This optimizes in particular the areal stability of the adjacent plates of the overflow member.

A space saving arrangement of the overflow member in the design of the plate-type heat exchanger is achieved, with a preferred embodiment of the invention, by arranging the overflow member so that it will be positioned flat in engagement with an external plate of the stack of plates. Moreover, this favors the shortest possible overflow connection between the outlet of the gas-coolant heat exchanger and the gas-gas heat exchanger.

With an advantageous further development of the invention, more extensive use is made of soldering technology as normally applied to connect the stack of plates of the plate-type heat exchanger and, in the present case, used also for securing the overflow member to the external plate of the stack of plates by soldering. That, at the same time, results in firmly seating the overflow member on the stack of plates of the plate-type heat exchanger.

With a preferred further development of the invention, a portion of the overflow spaces is formed between the overflow member and the external plate of the stack of plates, thus making it possible to save material in the manufacture of the plate-type heat exchanger. As a result, overflow spaces are located at either side of the external plate of the overflow member itself, facing the stack of plates.

The invention will be described further, by way of example, with reference to the accompanying drawing, in which:

DETAILED DESCRIPTION OF THE INVENTION

Figure 1:
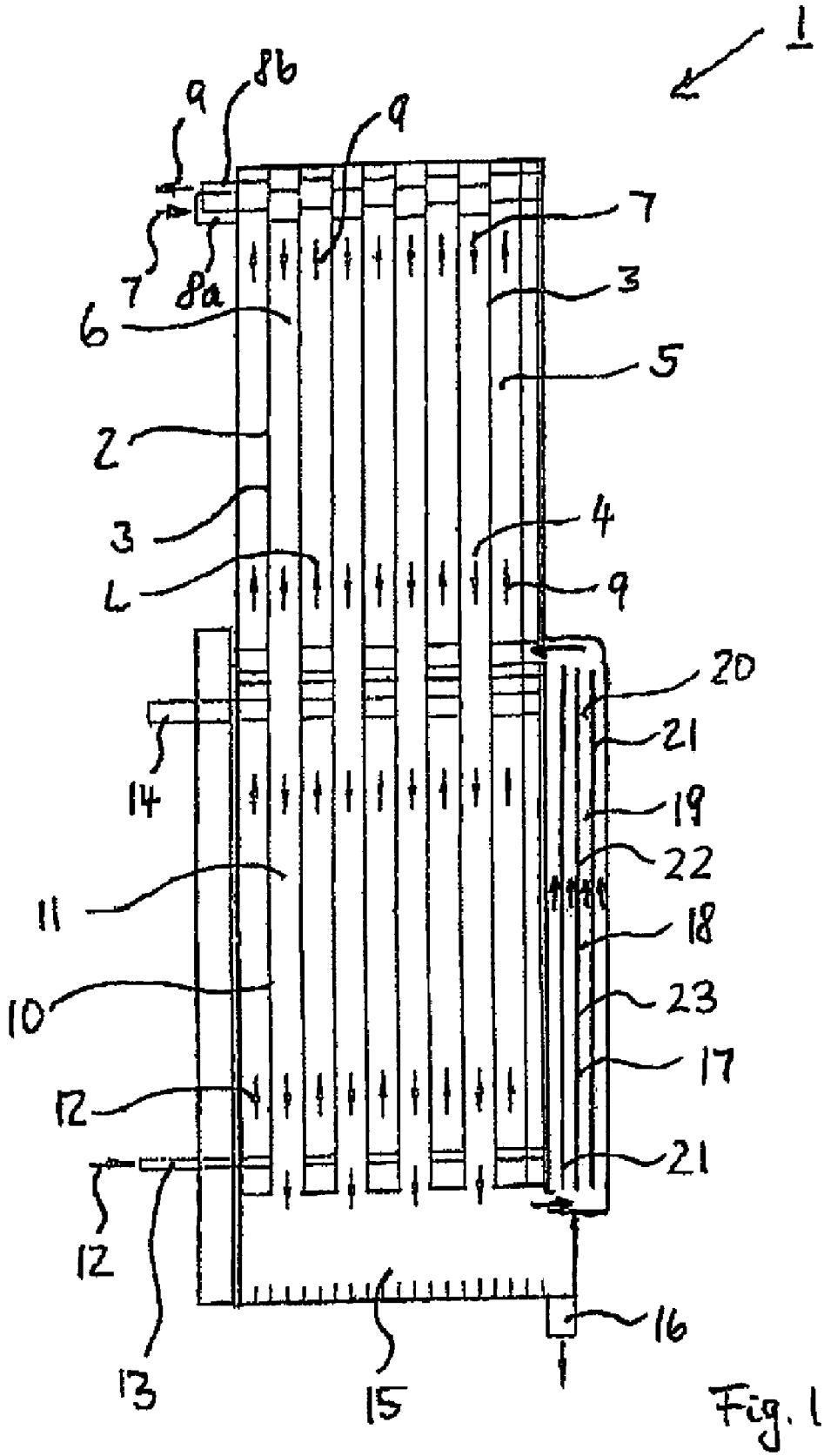
FIG. 1 is a longitudinal sectional elevation of a plate-type heat exchanger for drying a gaseous medium.

A plate-type heat exchanger 1 for drying a gaseous medium, especially air is shown in longitudinal section in FIG. 1. The plate-type heat exchanger 1 includes a stack 2 of a plurality plates 3 which are connected by solder in the embodiment, as is usual with soldered plate-type heat exchangers, thus defining a plurality of flow spaces 4 shaped like channels between the plurality of plates 3. In an upper portion 5 of the plate-type heat exchanger 1 a gas-gas heat exchanger 6 is formed of the plurality of plates 3 and flow spaces 4. A moist inlet gas stream 7 supplied through an inlet connection 8*a* flows into the gas-gas heat exchanger 6, in downward direction in the flow spaces 4, in countercurrent with respect to an upwardly flowing outlet gas stream 9. Having passed the gas-gas heat exchanger, the moist inlet gas stream 7 flows between the plates 3 in a lower portion 10 of the plate-type heat exchanger 1 where a gas-coolant heat exchanger 11 is formed. In the gas-coolant heat exchanger 11, a coolant 12 is fed between the plates 3 through a coolant connection 13 so that the coolant 12 between the plates 3 flows in upward direction, in other words, towards the moist inlet gas stream 7 which flows downwards. The coolant 12 leaves the plate-type heat exchanger 1 through a coolant outlet 14 and is returned to a cooling step. The moist inlet gas stream 7 is cooled in the gas-coolant heat exchanger 11 to below the given dew point of the respective gaseous medium, whereby amounts of moisture condense and deposit in a trap 15 in the lower portion 10 of the plate-type heat exchanger 1. Then the condensed moisture particles may be discharged through an outlet opening 16.

The gaseous medium thus cooled and dried flows back, after the condensation step, through an overflow connection 17 into the gas-gas heat exchanger 6. An overflow member 18 is arranged in the overflow connection 17, and overflow spaces 19 through which the dried outlet gas stream flows are defined in the overflow member 18. The overflow member 18 is made up of a stack 20 of a plurality of plates 21 with which side surfaces facing each other are interconnected by means of contact zones. The contact zones include edge contact zones 22 and/or areal contact zones 23 where the side surfaces facing each other touch each other, optionally by way of a suitable connecting agent, such as solder. In this manner a pressure resistant overflow member 18 is obtained. Zones located in particular in the central area of the plurality of plates 21, where the plurality of plates 21 comprise embossments, may be utilized to form the areal contact zones 23 so that parts of the embossments of adjacent plates will touch each other.

The interior of the plate-type heat exchanger 1 may be lined with a suitable material, for instance, a plastic material that is resistant to the gaseous medium to be dried.

Moist pressurized air originating from different production processes, for example, may be dried by means of the plate-type heat exchanger 1. Prior to exiting from the plate-type heat exchanger 1 through an outlet connection 8*b* in the gas-gas heat exchanger 6, the dried pressurized air or, in other cases, the dried gaseous medium, flowing upwardly, is heated anew by thermal transfer from the moist inlet gas stream 7. In this way, a heated gas stream which is adapted to process conditions in terms of a given minimum temperature can be recycled by means of the plate-type heat exchanger 1.

The features of the invention disclosed in the specification above, in the claims and drawing may be significant to implementing the invention in its various embodiments, both individually and in any combination.

What is claimed is:

1. A plate-type heat exchanger for drying a gaseous medium, especially air, comprising a stack of plates which are interconnected to define flow spaces between the plates, a gas-gas heat exchanger being formed in one portion of the stack, with a moist inlet gas stream flowing away from an inlet gas connection and a dried outlet gas stream flowing towards an outlet gas connection, both flowing next to each other through separate flow spaces to exchange thermal energy, and a gas-coolant heat exchanger being formed in another portion of the stack, with a coolant and the moist inlet gas stream flowing next to each other through further separate flow spaces for cooling purposes, and a flow connection being formed between an outlet of the gas-coolant heat exchanger and the gas-gas heat exchanger and including an overflow member to guide the dried outlet gas stream through the overflow member from the gas-coolant heat exchanger to the gas-gas heat exchanger, wherein that the overflow member is formed of a stack of adjacent plates which are interconnected to define overflow spaces between the adjacent plates, wherein edge sections of side surfaces of the stack of adjacent plates facing each other contact each other, optionally by way of a connecting material.

2. A plate-type heat exchanger for drying a gaseous medium, especially air, comprising a stack of plates which are interconnected to define flow spaces between the plates, a gas-gas heat exchanger being formed in one portion of the stack, with a moist inlet gas stream flowing away from an inlet gas connection and a dried outlet gas stream flowing towards an outlet gas connection, both flowing next to each other through separate flow spaces to exchange thermal energy, and a gas-coolant heat exchanger being formed in another portion of the stack, with a coolant and the moist inlet gas stream flowing next to each other through further separate flow spaces for cooling purposes, and a flow connection being formed between an outlet of the gas-coolant heat exchanger and the gas-gas heat exchanger and including an overflow member to guide the dried outlet gas stream through the overflow member from the gas-coolant heat exchanger to the gas-gas heat exchanger, wherein that the overflow member is formed of a stack of adjacent plates which are interconnected to define overflow spaces between the adjacent plates, wherein sections projecting from a plane of a plate, presenting the side surfaces which face each other of adjacent plates, are in touch with each other, optionally by way of a connecting material.

3. The plate-type heat exchanger as claimed in claim 1, wherein the adjacent plates of the overflow member comprise an embossed surface structure at least in partial areas.

4. The plate-type heat exchanger as claimed in claim 1, wherein the overflow member is arranged lying flat on an external plate of the stack of plates.

5. The plate-type heat exchanger as claimed in claim 4, wherein the overflow member is soldered to the external plate of the stack of plates.

6. The plate-type heat exchanger as claimed in claim 4, wherein a portion of the overflow spaces is defined between the overflow member and the external plate of the stack of plates.

* * * * *